US008651535B2

(12) United States Patent
Oppel et al.

(10) Patent No.: US 8,651,535 B2
(45) Date of Patent: Feb. 18, 2014

(54) ELECTRIC HOUSEHOLD APPLIANCE HAVING A CHILD SAFETY FEATURE

(75) Inventors: Anton Oppel, Syrgenstein (DE); Erich Schmid, Sontheim/Brenz (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1437 days.

(21) Appl. No.: 10/579,280

(22) PCT Filed: Nov. 15, 2004

(86) PCT No.: PCT/EP2004/052956

§ 371 (c)(1),
(2), (4) Date: Jan. 25, 2007

(87) PCT Pub. No.: WO2005/047630

PCT Pub. Date: May 26, 2005

(65) Prior Publication Data

US 2007/0256715 A1 Nov. 8, 2007

(30) Foreign Application Priority Data

Nov. 14, 2003 (DE) ..... 103 53 331
Jan. 14, 2004 (DE) ..... 10 2004 002 008

(51) Int. Cl.
*E05C 3/06* (2006.01)
*E05C 19/10* (2006.01)

(52) U.S. Cl.
USPC .... 292/198; 292/100; 292/229; 292/DIG. 65; 292/DIG. 69

(58) Field of Classification Search
USPC ..... 292/181, 229, 100, DIG. 65, 92, 336.3, 292/DIG. 69, DIG. 22, 183, 80, 87; 126/42, 126/190, 198, 193, 191, 192, 197; 431/153
See application file for complete search history.

(56) References Cited

U.S. PATENT DOCUMENTS 2,046,612 A * 7/1936 Devereaux ..... 16/85
2,138,251 A * 11/1938 Lindstrom et al. ..... 292/198
2,931,205 A * 4/1960 Schmitz ..... 70/92

(Continued)

FOREIGN PATENT DOCUMENTS

DE 44 24 201 1/1996
DE 195 04 928 8/1996
DE 19601228 A1 * 7/1997

OTHER PUBLICATIONS

Computer Generated Translation for DE 196 01 228 A1, European Patent Office Website, http://gb.espacenet.com/search97cgi/s97_cgi.exe?Action=FormGen&Template=gb/EN/home.hts.*

(Continued)

*Primary Examiner* — Carlos Lugo
*Assistant Examiner* — Alyson M Merlino
(74) *Attorney, Agent, or Firm* — James E. Howard; Andre Pallapies

(57) ABSTRACT

The aim of the invention is to provide an electric household appliance, especially a dishwasher, comprising a child-proof lock which has a simple and reliable design and is easy to operate. According to the invention, a means for selectively blocking or slide which can be moved between two positions blocks, in a first position, the movement of the locking member, thereby activating the child-safety feature, and in a second position of the means for selectively blocking, does not block the movement of the locking member, thereby deactivating the child-safety feature.

19 Claims, 10 Drawing Sheets

(56) References Cited

U.S. PATENT DOCUMENTS

| | | | | | |
|---|---|---|---|---|---|
| 3,670,536 | A | * | 6/1972 | Klebba | 70/99 |
| 3,691,799 | A | * | 9/1972 | Hoffmann et al. | 70/84 |
| 3,719,248 | A | * | 3/1973 | Breitschwerdt et al. | 180/271 |
| 3,799,596 | A | * | 3/1974 | Nozomu et al. | 292/216 |
| 3,858,921 | A | * | 1/1975 | Kuki | 292/336.3 |
| 3,967,844 | A | * | 7/1976 | Torii et al. | 292/336.3 |
| 4,414,828 | A | * | 11/1983 | Takinami et al. | 70/84 |
| 5,312,143 | A | * | 5/1994 | Buckner | 292/230 |
| 6,048,001 | A | | 4/2000 | Miller et al. | |
| 6,158,787 | A | * | 12/2000 | Kutschat | 292/214 |
| 6,290,270 | B1 | | 9/2001 | Spiessl | |
| 6,364,379 | B1 | * | 4/2002 | Roberts et al. | 292/216 |
| 6,390,518 | B1 | * | 5/2002 | Elick | 292/216 |
| 6,730,882 | B2 | * | 5/2004 | Atkinson | 219/413 |
| 6,840,553 | B2 | * | 1/2005 | Dirnberger et al. | 292/341.16 |

OTHER PUBLICATIONS

International Search Report PCT/EP2004/052956.

* cited by examiner

ELECTRIC HOUSEHOLD APPLIANCE HAVING A CHILD SAFETY FEATURE

FIELD OF THE INVENTION

The invention relates to an electric household appliance, especially a dishwasher, comprising a door and a door lock for said door, comprising: a frame with an opening for a hook, a closing member such as a closing lever in said frame, a closing spring disposed between the closing member and a counter-bearing in said frame, said closing member being connected to a gripping device.

BACKGROUND OF THE INVENTION

Electric household appliances, especially dishwashers or an electric baking oven, pose a hazard for children which should not be underestimated. Children at play can accidentally or intentionally open the door of an electric household appliance and thereby expose themselves to a considerable risk of injury. In dishwashers this arises, for example, from pointed sharp objects such as knives since children can thereby incur cutting wounds. In baking ovens there is a considerable risk of injury as a result of the high temperatures. For this reason, mechanical devices which prevent any unintentional or undesired opening of the door of an electric household appliance are already available as child-safety features.

Known from DE 195 04 928 A1 is a door lock for a dishwasher for whose actuation an unlocking flap is mounted pivotally about a pivot axis in a handle recess and is provided with a locking stop arrangement which prevents any pivoting of the unlocking flap in a locking home position. Moulded on the pivot axis of the unlocking flap is a radially directed locking lug which engages axially in a matched stop in a bearing wall of the handle shell. A disadvantage here is that as a result of the complex structure, the child safety feature is expensive and liable to breakdown and the operating comfort for the user of the dishwasher is only low.

Known from DE 198 37 248 C2 is a door lock for the door of an electric household appliance comprising a frame with an opening for a hook, a closing member such as a closing lever, in the frame, a closing spring disposed between the closing member and a counter-bearing in the frame, said closing member being connected to a gripping device. In this case, the closing spring is tensioned in an open position of the door lock and the gripping device is pressed against a part of the frame or in the frame by the closing spring at a contact point in the open position of the door lock, thus preventing the release of the spring. The gripping device has a gripping latch into which a hook is guided on passing through the opening in the frame. The incoming hook presses on a contact surface of the gripping device and thereby causes a movement of the gripping device. The gripping device is shaped so that it loses contact with the contact point during a movement of the hook and the closing spring can thereby be released. The opening of the closed door by forces from inside or outside can only be prevented by a lock which releases the closing member during opening by means of an opening lever. This door lock disadvantageously therefore does not have a child safety feature which prevent undesired opening of the door.

SUMMARY OF THE INVENTION

It is thus the object of the present invention to provide an electric household appliance, especially a dishwasher with a door lock, having a child safety feature which allows high operating comfort to be achieved with a simple and reliable structure of the door lock.

The electric household appliance according to the invention, especially a dishwasher, comprising a door is provided with a door lock for said door, comprising a frame with an opening for a hook, a closing member such as a closing lever in said frame, a closing spring disposed between the closing member and a counter-bearing in said frame, said closing member being connected to a gripping device, wherein a pin or slide which can be moved between two positions, inhibits the movement of the closing member in a first position for activating a child safety feature and does not inhibit the movement of the closing member in a second position of the pin for deactivating the child safety feature.

In the first position where the child safety feature is activated, the movable pin is preferably inserted into a recess of the closing lever or lies at the edge of said closing lever and the movement of the closing lever is thereby positively inhibited.

Advantageously disposed on the movable pin is a locking head which in the first position of the pin with the child safety feature activated, is inserted in a recess of a portion of the door, for example, a side wall of the frame or a control panel so that as a result of a positive connection between the locking head and the boundary of the recess, the forces applied to the pin are predominantly transferred to the boundary of the recess.

In a further embodiment, in the second position with the 20 child safety feature deactivated, the movable pin is located outside the recess or the edge of the closing lever and thereby the movement of the closing member is not inhibited.

More appropriately, the pin can preferably be moved in a direction of movement perpendicular to the direction of movement of the closing member and the pin has a conical 25 shape with increasing diameter beginning at the free end of the pin so that when very high forces act on the closing member, as a result of a small angle of inclination, i.e. 20° between the circumferential surface of the pin and the bearing surface on the pin, e.g. the boundary surface of the recess, the pin can be moved into the second position due to resulting normal forces in the pin.

In another embodiment, the closing spring is tensioned in an open position of the door lock, the gripping device is pressed against a part of the frame or in the frame by the closing spring at a contact point in the open position of the door lock, thus preventing the release of the spring, the gripping device has a gripping latch into which a hook is guided on passing through the opening in the frame and has a contact surface onto which the incoming hook presses, thereby causing a movement of the gripping device and the gripping device is shaped so that it loses contact with the contact point during a movement of the hook and the closing spring can thereby be released.

Advantageously, the pin is fixed to a pivoted shaft by means of a pivoted lever so that the pin can execute a rotary movement from the first position into the second position and conversely.

More appropriately, by means of a restoring lever connected to the pivoted shaft and a spring, a restoring moment can be applied to the pivoted shaft so that the pin is pressed into the first position to activate the child safety feature.

In an additional embodiment, a preferably rectangular plate made of plastic with a locating lug and a limiting lug is formed on an adjusting lever connected to the pivoted shaft wherein as a result of the thickness of the plate, said plate 20 can be elastically deformed under application of small forces.

Advantageously beginning with the free end, the adjusting lever projects partly over a slot-shaped recess in a gripping shell into a handle of the door such that as a result of a movement of the adjusting lever the pin can be moved from the first position into the second to position to activate and deactivate the child safety features, wherein the direction of movement of the adjusting lever in the handle is preferably lateral and horizontal.

More appropriately, the adjusting lever can be detachably fixed in the second position of the pin for continuous deactivation of the child safety feature, whereby the adjusting lever rests with a limiting strip on a flat area, e.g. of the panel dish and the movement of the adjusting lever to the first position is blocked by the locating lug on the limiting strip.

In an additional embodiment, to activate the child safety feature, the locating lug can be raised over the limiting strip through a small recess in the gripping shell of the handle using a pointed object, so that as a result of the force of the spring, the adjusting lever can be moved into the first position and for continuous deactivation of the child safety feature, the locating lug can be raised over the limiting strip using a pointed object whilst simultaneously activating the adjusting lever in the handle.

Advantageously, the pin is arranged on an actuating slider in a slider housing and by means of a translational movement of the actuating slider in the slider housing, the pin can be moved between the first position and the second position and conversely, preferably between two stop points.

In another embodiment, an actuating lever 8 is formed on the actuating slider which projects via a slot in the gripping shell of the handle therein and the actuating slider can thereby be moved from the handle with the actuating lever between the first and second position, wherein the actuating lever can be pressed into the first position by a spring.

More appropriately, a locating lug is formed on the actuating slider which in the second position of the actuating slider engages in a recess of the slider housing and preferably either the displacement of the actuating slider from the second position into the first position can be executed only by the actuating lever or the locating lug must be additionally pressed in via a recess on the gripping shell of the handle using a sharp object.

Advantageously, the movement of the pin from the first to the second position and conversely to activate and deactivate the child safety feature is adjustable from the top of the door using an actuating element.

In another embodiment, the actuating element, e.g. a lever, a cup-shaped disk or a part which can be actuated using a screwdriver is arranged fixedly or removably on the top.

In a further embodiment, the actuating element is connected to an actuating shaft on which a cam is formed and using the cam on the actuating shaft the pivoted lever with pin can be moved from the first into the second position and conversely.

More appropriately, the movement of the pin from the first to the second position and conversely to activate and deactivate the child safety feature can be executed by a preferably electric actuator, e.g. a wax expansion element, a bimetal part, an electromagnet or an inserted/withdrawn memory part.

In an additional embodiment, the actuator can be controlled using an electric, electronic or mechanical control using a specific control logic wherein, for example, the child safety feature is continuously activated, only activated during operation or a certain button or button combination must be pressed to deactivate the child safety feature.

The actuator can preferably be controlled by remote control, preferably via a radio signal or via the internet. As a result, the operator need not stay at the household appliance to actuate the child safety feature but he can conveniently execute it from any location in the vicinity of the household appliance. For household appliances connected to the interne, it can even be actuated from any computer with interne access.

BRIEF DESCRIPTION OF THE DRAWINGS

The present invention is explained in detail hereinafter with reference to the exemplary embodiment shown in the drawings 8 25.

In the figures.

DETAILED DESCRIPTION OF THE PREFERRED EMBODIMENTS

Figure 1:
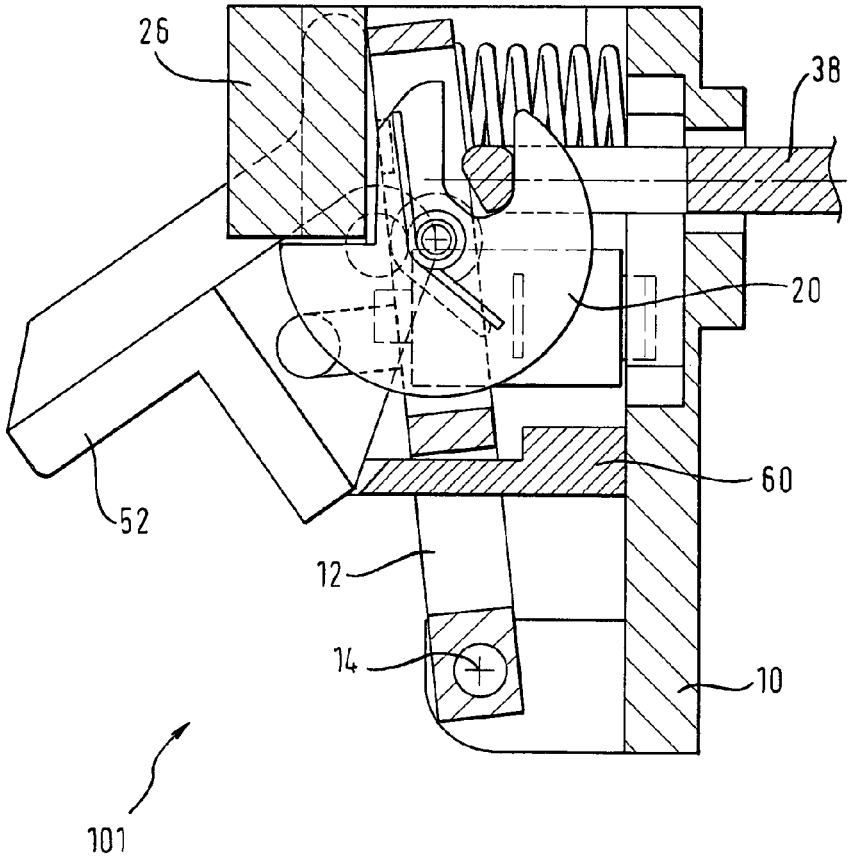
Fig. 1 Prior Art
FIG. 1 is a section through a door lock from the prior art.
Figure 2:
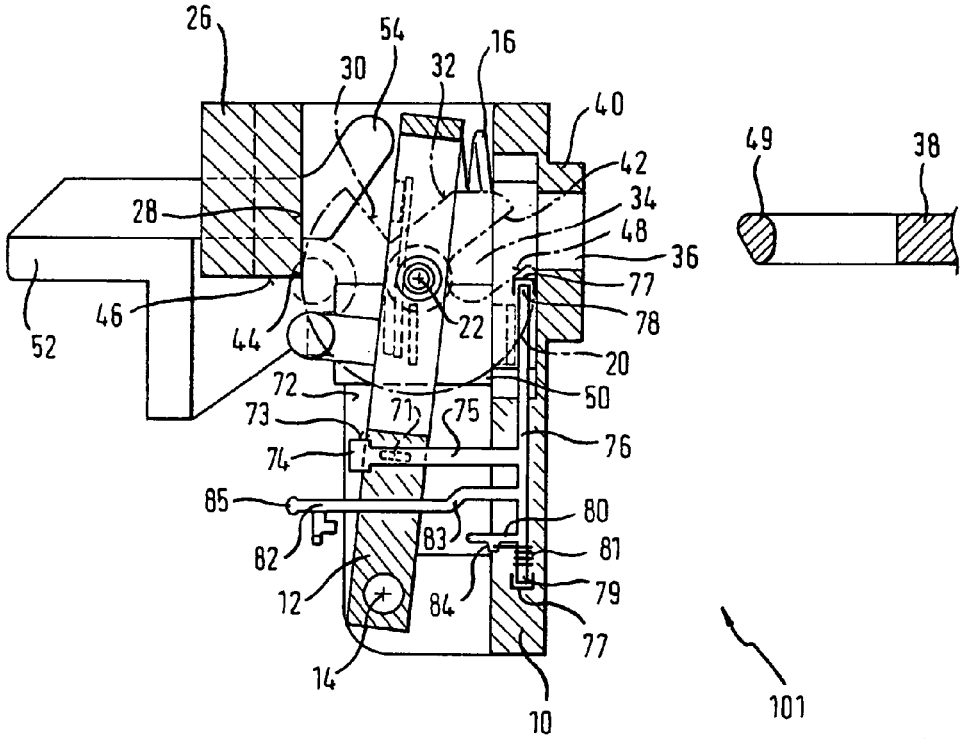
FIG. 2 is a section through a door lock according to the invention in the open position.
Figure 3:
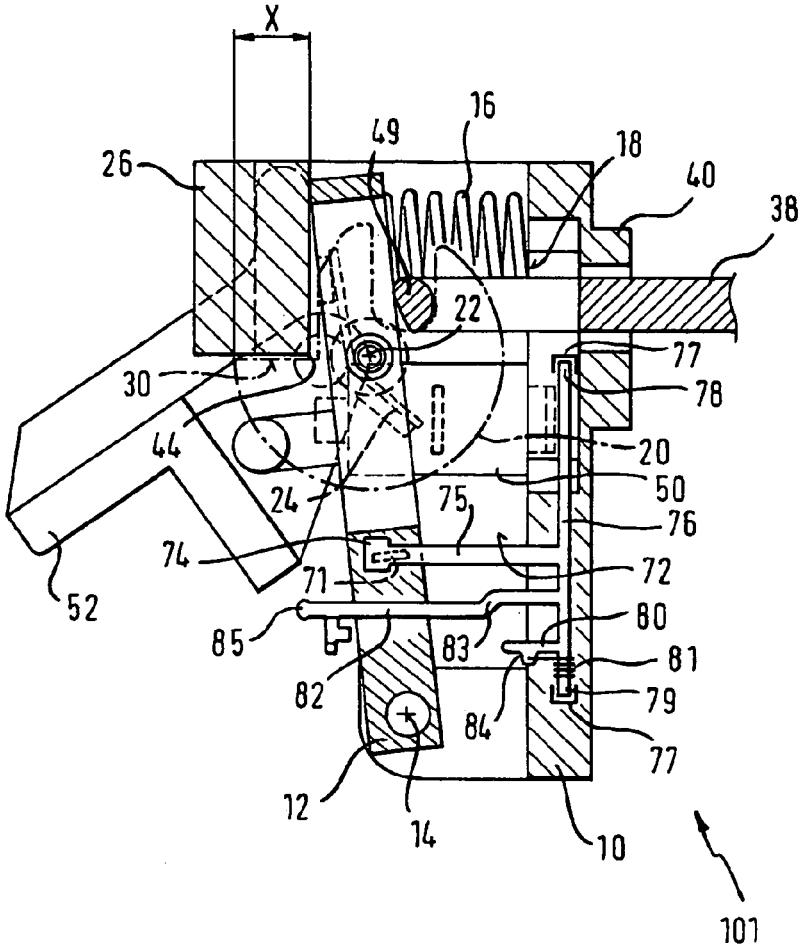
FIG. 3 is a section through a door lock according to the invention in the closed position.

The operating mode of the door lock 101 is first explained hereinafter disregarding the child safety feature with reference to FIGS. 1 to 3. The child safety feature according to the invention is also shown in FIGS. 2 and 3. FIG. 1 exclusively shows a door lock from the prior art without child safety feature. The door lock in FIG. 1 is a door lock known from DE 198 27 248 C2.

A closing lever 12 pivotable about an axis 14 is accommodated in a frame 10. In the open position of the door lock 101 shown in FIG. 2 a closing spring 16 is tensioned between the closing lever 12 and a counter-bearing 18, thus pressing the closing lever 12 in the counterclockwise direction.

A gripping device 20 is mounted rotatably about an axis 22 on the closing lever 12. The axis 22 of the gripping device 20 is located on the closing lever 12 between the area on which the closing spring 16 acts and the axis 14 of the closing lever 12. The gripping device 20 has a circumferential line which forms a pitch circle about the axis of rotation. As a result of the closing spring 16, the gripping device 20 is pressed against a stop face 28 on a stop member 26 of the frame 10.

The circumferential line of the gripping device 20 leads to a slide edge which runs radially inwards at an angle of 90° from a tangent of the circumferential line of the gripping device 20. A stop edge 32 of the gripping device 20 is located perpendicularly to the slide edge 30.

The gripping device 20 is located in a recess of the closing lever 12. In the exemplary embodiment shown the closing lever 12 is tensioned counterclockwise by two closing springs 16 (only one is shown in FIGS. 1 to 3). According to the diagram in FIGS. 2 and 3, therefore closing spring 16 is located in the viewing direction of the observed in front of the gripping device 20 and one closing spring is located behind the gripping device 20.

A gripping latch 34 is embodied as an eccentric indentation in the circumference of the gripping device. In the open position of the door lock 101, its opening points towards an opening 36 in a side 40 of the frame 10 facing a hook 38. When the hook 38 is guided through the opening 36 on closing the door 95, it presses on a contact surface 42 of the gripping latch 34 and cause the gripping device 20 to turn counterclockwise. As a result of the turning, the slide edge 30 reaches a corner 44 of the frame 10. The closing spring 16 can be released, the closing lever 12 turns about the axis 14 and the gripping device 20 slides with the slide edge 30 along a surface 46 of the frame 10, whereby the slide edge 30 is pressed against the surface 46 of the frame 10 by the torsion spring 24. The front portion 49 of the hook 38 has contact with a second contact surface 48 of the gripping latch 34 and is entrained by the gripping latch 34. In this case, the door 95 is pressed against the seal. At the same time as these movements, a door switch 50 which is actuated by means of the closing lever 12 is closed, the torsion spring 24 is tensioned and an opening lever 52 is moved by the closing lever 12 acting on an arm 54 of the opening lever 52. This results in the closed position of the lock 101 shown in FIG. 3.

When the lock 101 is opened, the opening lever 52 is moved clockwise, and the arm 54 of the opening lever 52 presses together the closing lever 12 clockwise and the closing spring 16. In this case, the gripping device 20 again slides with the slide edge 30 along the surface 46 of the frame 10 (FIG. 3 to the right), 15 until the gripping device 20 is returned by the torsion spring 24 (possibly in cooperation with a seal pressing the door away from the housing of the appliance) into the position corresponding to the open position of the door lock, where the hook 38 is released and the door opens. At the same time as opening the lock, the door switch 50 is actuated by the closing lever 12 and is opened.

The tolerance of the hook 38 in the closed position is determined by the length of the slide edge 30. The front portion 49 of the hook 38 cannot snap out of the gripping latch 34 as long as the gripping device 20 does not turn, i.e. as long as the closing lever 12 only turns about its axis 14.

Shown in FIG. 1 as prior art is the door lock 101 with an additional lock 60 compared with FIGS. 2 and 3, apart from the child safety feature according to the invention, which prevents opening of the closed door by forces from inside or outside. The forces acting on the door can, for example, be a steam impact from inside or a pulling open from outside. The lock 60 can, for example, be embodied as the edge on the frame 30 or as an additional part. The lock 60 prevents turning of the closing member 12 in the opening direction before the gripping device 20 is released over the slide edge 30 on the corner 44. During opening by means of the opening lever 52, first the closing member 12 is released and then the door 35 is opened. Disadvantageously each opening with the opening lever 52 effects a release of the closing member 12 so that children can lift the lock 60. The child safety feature according to the invention can naturally also be executed on a door lock 101 with an additional lock 60 according to FIG. 1.

In order to eliminate undesired opening of the appliance door 95, e.g. by children as a child safety feature, according to the invention a pin 70 or a slider (not shown) can be inserted in a recess 71 in the closing lever 12. The pin 70 can rest on a wall of the closing lever 12 (not shown) to block the closing lever 12. The pin 70 in the recess 71 positively blocks the rotary movement of the closing lever 12 about the axis 14 in the closure position (FIG. 2). As a result, the gripping device 20 does not release the hook 38 and the door cannot be opened. In the open position the pin 70 is located outside the closing lever 12, for example, it lies on the wall of the closing lever 12. The frame 10 preferably has a side wall 72 in the area of the recess 71 of the closing lever 12 with a recess 73. In the closed position the recess 73 in the side wall 72 of the frame 10 and the recess 71 of the closing lever are in alignment with one another. The side wall 72 is located in front of the closing lever 12 in the view in FIGS. 2 and 3.

Viewed from the plane of the drawing from FIGS. 2 and 3, a locking head 74 is constructed on the pin 70 which, depending on the type of plug connection, is inserted as an exact fit with little play into the recess 73 in the closed position. By this means the forces applied to the pin 70 by the recess 71 on the closing lever 12 are transferred via the locking to head 74 to the recess 73 of the frame 10.

As a result of the short distance between the locking lever 12 and the side wall 72 of the frame 10, predominantly only transverse forces thereby occur at the pin 70 and at the locking head 74 and only a small bending moment. High stressing of the material can thereby be avoided even when large forces act on the pin 70 and the movable mounting for the pin 70 can be executed simply and therefore inexpensively because only very small forces act on this mounting. Such a recess 73 for positive retaining of the locking head 74 and therefore the pin 70 can also be constructed in a wall which is not part of the frame 10, e.g. in the panel housing, where this wall must be located at the shortest possible distance from the closing lever 12.

Figure 7:
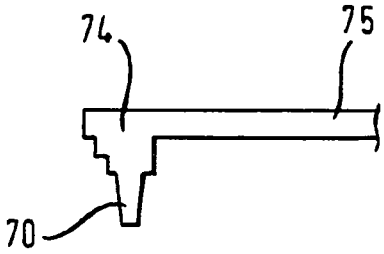
FIG. 7 is a side view of the pivoted lever with pin according to the invention.

Step-shaped gradations are advantageously formed on the locking head 74 which run perpendicular to the plane of the drawing in the alignment from FIGS. 1 and 2 and therefore in the direction of the longitudinal axis of the pin 70 (FIG. 7). Thus, in the closed position when the closing lever 12 is blocked, the locking head 74 rests with one gradation, preferably the last gradation, on the side wall 72 of the frame 10 on the recess 73 (not shown). The insertion of the pin 70 into the recess 71 of the closing lever 12 can thereby be limited in the closed position.

The pin 70 is preferably shaped as conical with decreasing diameter towards the end of the pin 70 (FIG. 7). As a result, in the event of a fault with the lock for example, the door can still be opened with very much increased force in the closed position with the child safety feature activated because as a result of the conical shape of the pin 70, the casing surface of the pin 70 rests at a very small angle of inclination, e.g. 20° on the recess of the closing lever 12. As a result, a force applied via a panel handle of the door on the recess 71 and the pin 70 brings about a normal force in the pin 70, in addition to a transverse force, which presses said pin out from the recess 71. It is thereby advantageously possible to open the door in an emergency, e.g. in the event of a defect in the device for the child safety feature, e.g. the locking device 69.

Figure 4:
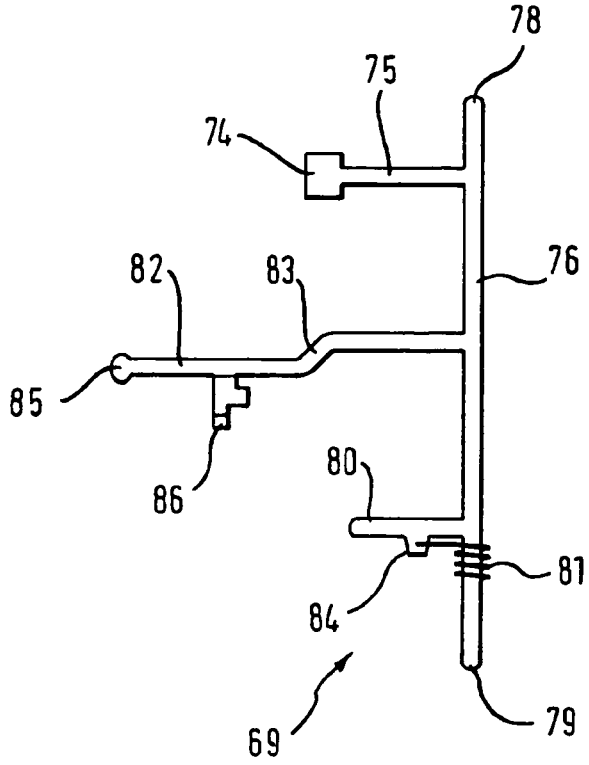
FIG. 4 is a plan view of a locking device according to the invention.

There are various possibilities for implementing the mounting for the movement of the pin 70:

In a first embodiment (FIG. 1, 2, 3, 4, 5, 6, 7) the pin 70 with locking head 74 is affixed to a pivoted lever 75, the axis of the pin 70 preferably being perpendicular to the axis of the pivoted lever 75. The pivoted lever 75 opens into a pivoted shaft 76 of the locking device 69 which preferably consists of plastic. In this case, the axis of the pivoted lever 75 is also preferably perpendicular to the axis of the pivoted shaft 76. The pivoted lever 75 is preferably executed as substantially rectangular in cross-section so that it is better able to absorb a bending moment, the longitudinal side being substantially longer than the broad side, e.g. by a factor of four. The longitudinal sides are parallel to the axis of the pin 70. The pin 70 can thereby absorb large bending moments. The pivoted shaft 76 is rotatably mounted by a simple friction bearing 77 at the upper end 78 and the lower end 79 (FIGS. 2 and 3). Located near the lower end 79 of the pivoted shaft 76 is another restoring lever 80 with a projection 84. Located on the upper side of the projection is a wire of a torsion spring 81 whereby a force is continuously applied to the restoring lever 80 (FIG. 4). This produces a continuous restoring torque via the restoring lever 80 in the pivoted shaft 76, which is directed counterclockwise when viewed in the direction of the axis of the pivoted shaft 76 form the lower end 79 to the upper end 78. The pin 70 is thereby pressed continuously in the direction of the recess 71 of the closing lever 12. In each closed position the pin 70 is therefore pressed into the recess 71 of the closing lever 12. The child safety feature is thus activated.

A mechanism which prevents the pin 70 from being inserted into the recess 71 of the closing lever 12 is required to deactivate the child safety feature. For this purpose another adjusting lever 82 is arranged in the pivoted shaft 76 between the pivoted lever 75 and the restoring lever 80.

Figure 5:
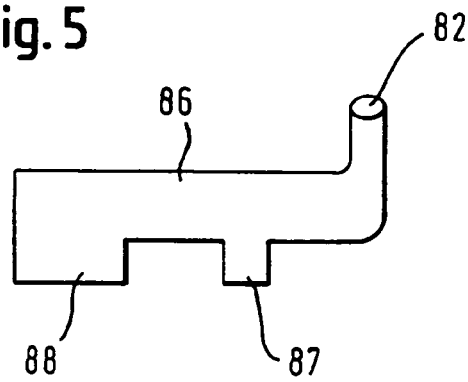
FIG. 5 is a plan view of a plate according to the invention as part of the locking device.
Figure 6:
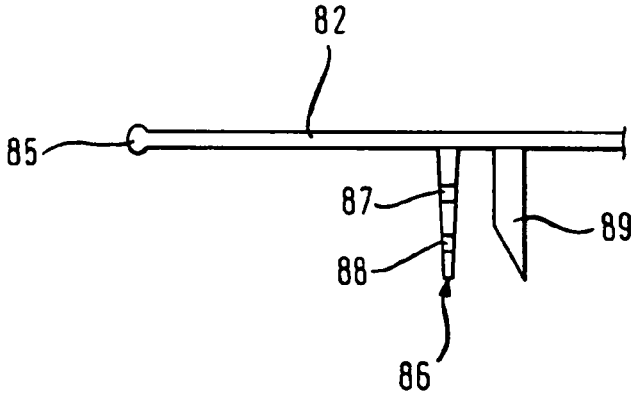
FIG. 6 is a plan view of an adjusting lever according to the invention as part of the locking device.

The axis of the adjusting lever 82, like that of the levers 75, 80, is perpendicular to the axis of the pivoted shaft 76. The adjusting lever 82 is not executed as straight like the other levers 75, 80 but has an offset 83 approximately at the centre, directed towards the lower end 79 of the pivoted shaft (FIG. 4). The axes of the two halves of the adjusting lever 82 before and after the offset 83 are parallel, i.e. are perpendicular on the axis of the pivoted shaft 76. A rectangular plate 86 (FIGS. 4, 5, 6) 18 is constructed on the second half of the adjusting lever 82, i.e., between the free end 85 of the adjusting lever 82 and the offset 83, in the vicinity of the offset 83. The plane of the plate 86 is perpendicular to the axis of the adjusting lever 82 (FIGS. 1, 2 and 6). The longitudinal sides of the rectangular plate 86 are approximately perpendicular to the axis of the adjusting lever 82, i.e., the plate 86 is directed approximately perpendicularly downwards in the plane of the drawing in FIGS. 2, 3 and 4. A locating lug 87 and a limiting lug 88 are constructed on the plate 86 as an extension of the plate 86. The plate 86 and therefore the lugs 87, 88 are preferably slightly wedge-shaped, i.e. with increasing thickness in the direction of the pin 70. The thickness of the plate 86 is relatively small, e.g. between 1 and 2 mm, so that as a result of using plastic the plate 86 is very flexible towards small forces. Furthermore, a wedge 89 (FIG. 6) is located on the second half of the adjusting lever 82 with increasing thickness in the direction of the pin 70.

The adjusting lever 82, preferably in an easily identifiable colour, projects in the area of the free end 85 approximately as far as the recess 93 in the handle to actuate the door on the panel shell. At the same time, a slot-shaped, horizontal recess is provided in the gripping shell 93 of the handle so that the adjusting lever 82 can be moved from outside in the handle (not shown). Advantageously, the adjusting lever 82 can only be displaced laterally in the horizontal direction in the handle so that any unintentional movement of the adjusting lever 82 is eliminated because this must be specifically moved sidewards in the handle. A child is unable to do this. In different panel designs the adjusting lever must be located at different height positions. For this purpose only one adjusting lever 82 with a different offset 83 needs to be selected with an otherwise identical locking device 69. The child safety feature can thereby be activated and deactivated because the pivoted shaft 76 is also turned by the movement of the adjusting lever 82 and thus the pin 70 can be moved into or out of the recess 71 of the closing lever 12. In this case, before every opening of the door the adjusting lever 82 must be displaced laterally in the horizontal direction against the spring force of the spring 81 towards the lateral end of the handle. If this does not take place, e.g. if a child is does not known how to do this, the door cannot be opened because the pin 70 remains in the recess 71 of the closing lever 12 and the movement of the closing lever 12 is blocked by the fixing of the locking head 74 in the recess 73 of the side wall of the frame 10.

In a preferred embodiment the adjusting lever 82 can be fixed in the state where the to child safety feature is deactivated, i.e. it is not necessary for the adjusting lever 82 to move in the handle to open the door. In this case, a small round recess (not shown) is additionally located in the handle. The plate 86 which is located on the adjusting lever 82 then rests on a flat area in the panel shell, where a limiting strip is provided on a flat area (not shown) between the locating lug 87 and the limiting lug 88 in the deactivated state of the child safety feature. This prevents movement of the adjusting lever 82, especially the return movement into the first position in the activated state of the child safety feature is blocked by the locating lug 87 on the limiting strip. The adjusting lever 82 can thus not be moved and as a result of the position of the adjusting lever 82, the pin 70 is outside the recess 71 of the closing lever 12 so that the door lock cannot be blocked. As a result of the spring force of the spring 81, the locating lug 87 rests on the limiting strip oh the flat area (not shown). To activate the child safety feature, i.e. to allow a movement of the pin 70 into the recess 71 of the closing lever 12, the adjusting lever 82 must be released from this position again. For this purpose, a pointed object, e.g. a ball-point pen should be inserted into the small round recess on the handle. The locating lug 87 is thereby raised over the limiting strip, which can advantageously be achieved with small forces because of the resilient properties of the plate 86. The adjusting lever 82 thus folds back into the position of the activated child safety feature on account of the restoring force of the spring 81. To deactivate the child safety feature, the adjusting lever 82 must be displaced horizontally laterally in the handle and at the same time, a pointed object must be inserted into the small round recess so that the locating lug 87 can be raised over the limiting strip on the flat area (not shown) and the desired locking of the adjusting lever 82 with the locating lug 87 on the limiting strip against the restoring force of the spring 81 can be achieved. It is especially advantageous here if both a movement of the adjusting lever 82 and the insertion of a pointed object into the small recess is required simultaneously so that any unintentional deactivation of the child safety feature is almost eliminated.

Figure 8:
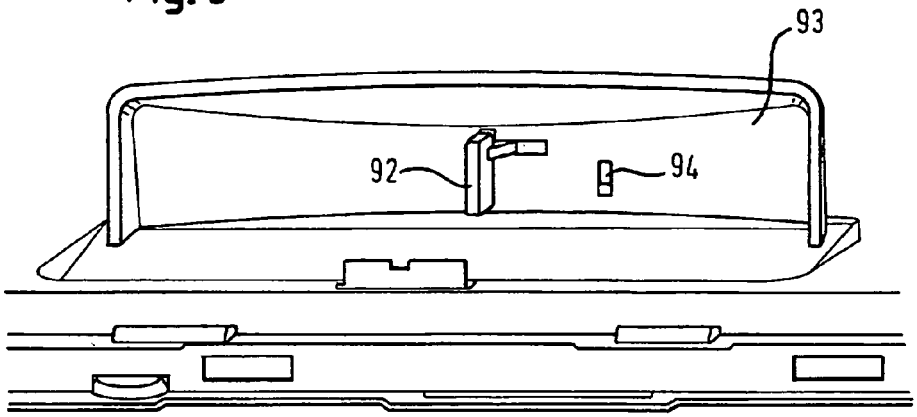
FIG. 8 is a perspective view of a gripping shell from below for a handle according to the invention.
Figure 9:
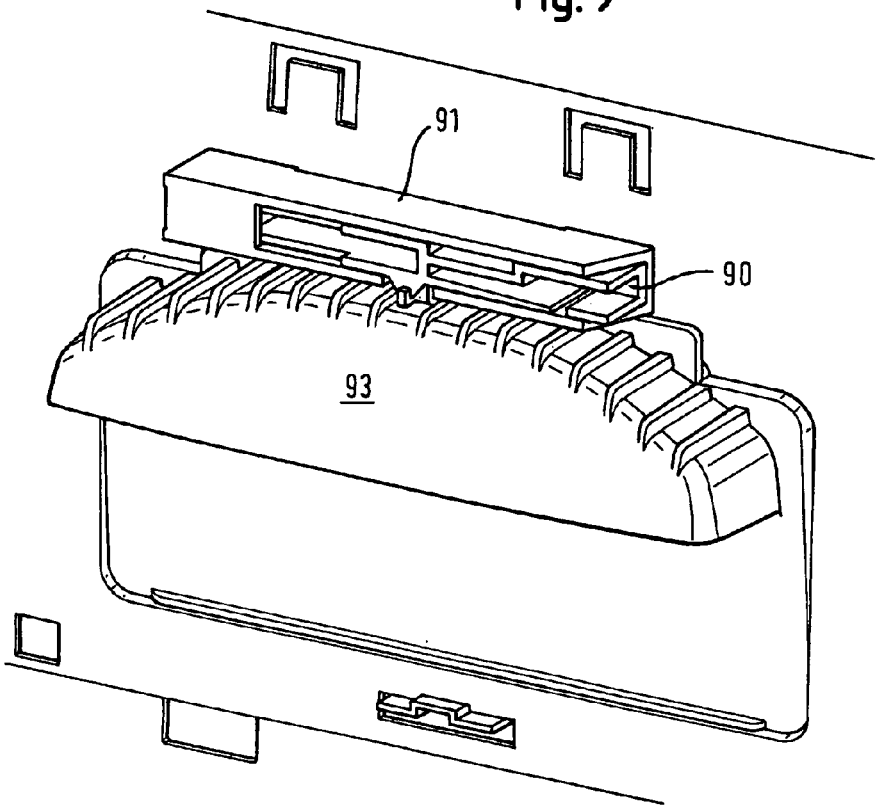
FIG. 9 is a perspective view of a gripping shell from above for a handle according to the invention.
Figure 10:
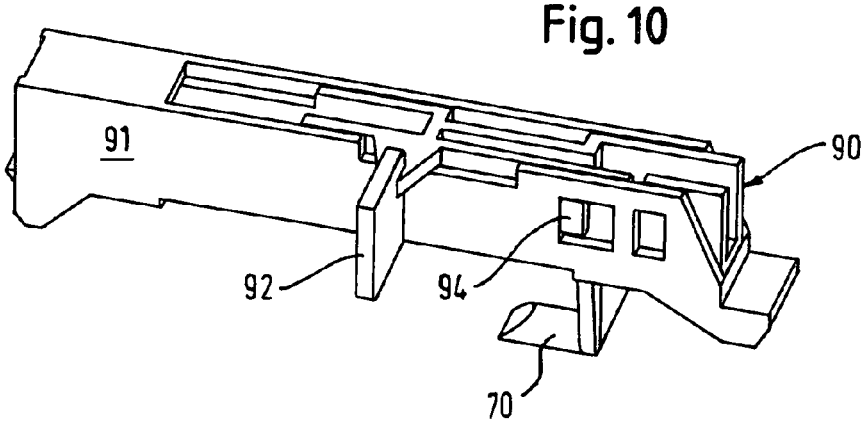
FIG. 10 is a perspective view of an actuating slider 15 according to the invention in a slider housing.
Figure 11:
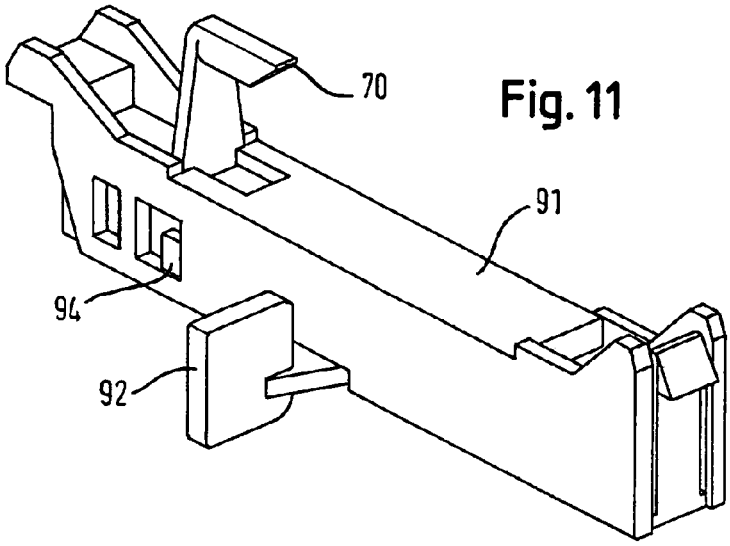
FIG. 11 is a perspective view of an actuating slider according to the invention in a slider housing.
Figure 12:
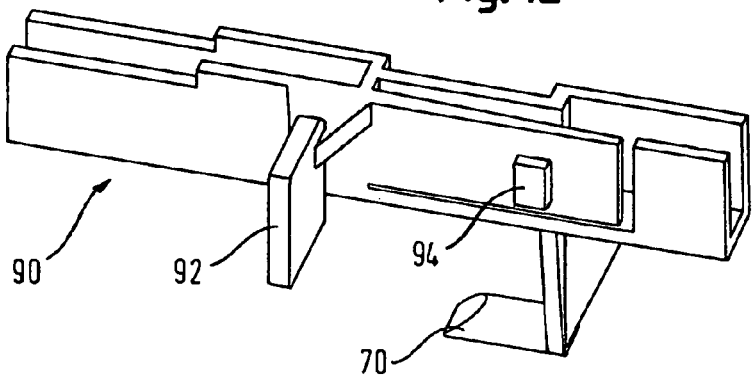
FIG. 12 is a perspective view of an actuating slider according to the invention.

In a second embodiment for mounting the movement of the pin 70 (FIGS. 8, 9, 10, 11, 12), said pin is disposed on an actuating slider 90. The actuating slider 90 is located in a slider housing 91 in which it executes a translational movement between two stop points. For movement of the actuating slider 90 an actuating lever 92 is formed thereon, which projects into the gripping shell 93 of the handle via a slit therein (FIG. 8). The actuating slider 90 can thereby be moved. Also located in the slider housing 91 is a spring (not shown) which presses to the actuating slider 90 in the activated state of the child safety feature, i.e. so that in the closed position of the lock the pin 70 is pressed into the recess 71 of the closing lever 12. To open the door on the dishwasher the actuating slider 90 must be pressed using the actuating lever 92 against the force of the spring in the deactivated state of the child safety feature i.e. so that in the closed position of the lock the pin 70 does not project into the recess 71 of the closing lever 12. In a preferred embodiment a locating lug 94 is formed on the actuating slider 90 (FIG. 8, 10, 12). In the deactivated state this engages in a recess on the slider housing 91 whereby the actuating slider 90 is fixed in the deactivated state. As a result, the actuating lever 92 must be displaced in the handle to open the door. In addition to this, the locating lug 94 can be constructed on the actuating slider 90 such that to deactivate the child safety feature it is not merely sufficient to move the actuating lever into the corresponding position but in addition the locating lug 94 must be pressed with a pointed object. For this purpose, a suitably aligned recess is formed on the gripping shell 93 of the handle (FIG. 8). In a dishwasher, the slider housing 91 is preferably located above the gripping shell 93 for the handle.

Figure 13:
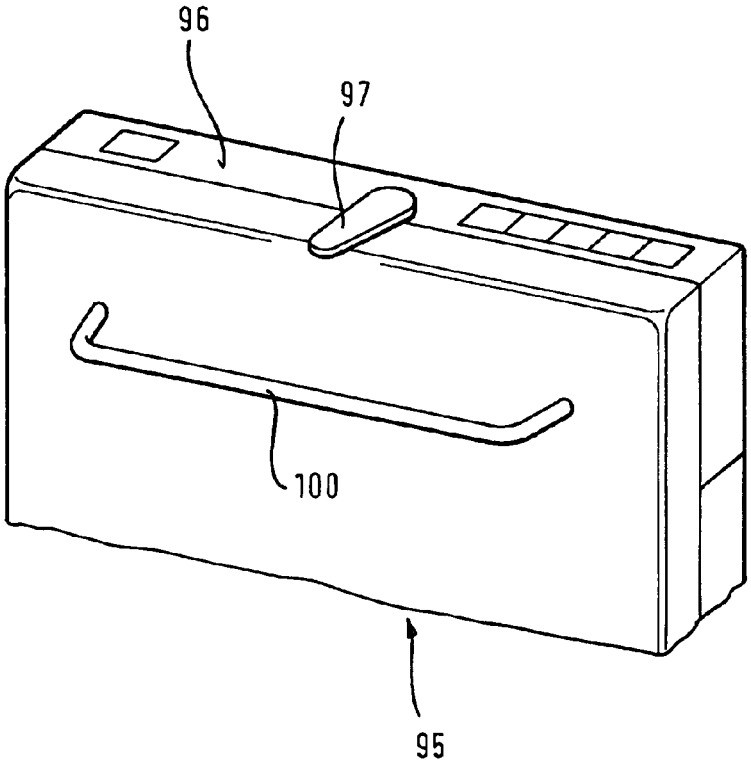
FIG. 13 is a perspective view of a door of a dishwasher according to the invention with an actuating element according to the invention at the top.
Figure 14:
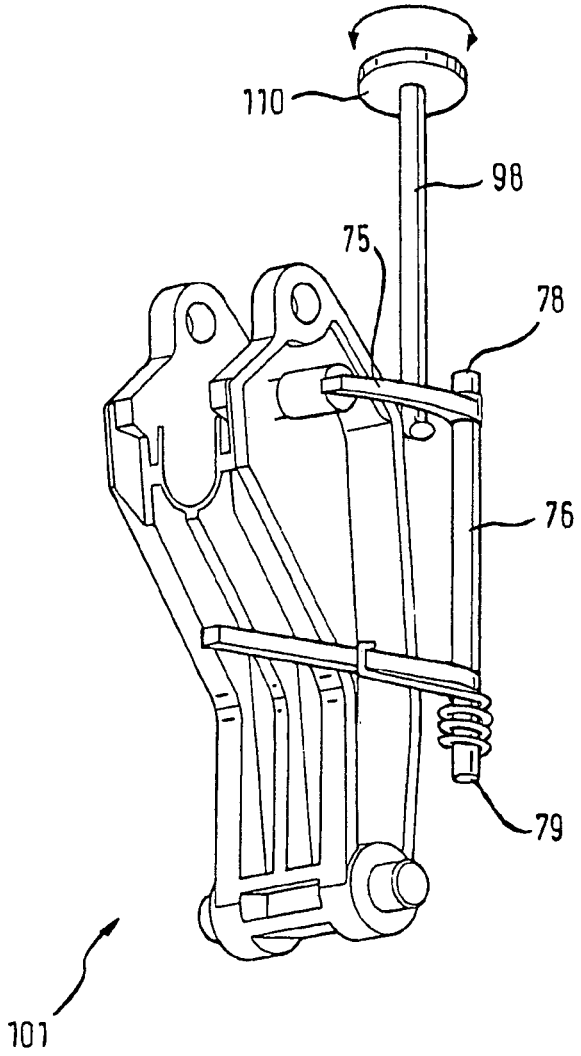
FIG. 14 is a perspective view of a door lock according to the invention with actuating shaft and actuating element.
Figure 15:
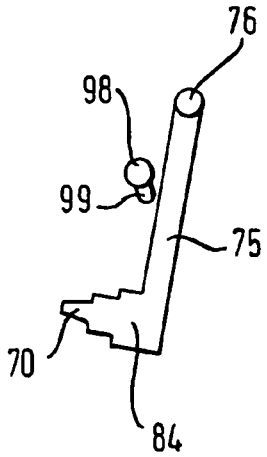
FIG. 15 is a cross-section through the actuating shaft with cam and pivoted lever according to the invention.

In a third mechanical embodiment of the invention, especially for fully integrable dishwashers and dishwashers with clip handles which do not have a handle, the child safety feature can be activated and deactivated from the top 96 of the door 95 by means of an actuating element 97 (FIG. 13). For this purpose the actuating element 97 is continuously or temporarily connected at the top 96 to an actuating shaft 98 with a removable actuating element 110 (FIG. 14). Located on the actuating element 98 is a cam 99 which raises the pivoted lever 75 during a rotary movement of the actuating shaft 98 (FIG. 15) and thereby deactivates the child safety feature. The actuating shaft 98 is preferably only rotatable within a certain angular range e.g. 30° as a result of corresponding additional protrusions on the actuating shaft 98 (not shown). In addition to this mechanism, other devices for activating and deactivating the child safety feature are also possible.

For example, the pivoted shaft 76 can be extended as far as the top 96 with the result that an additional actuating shaft 98 is not required (not shown).

The removable actuating element 110 can be variously executed. For example, it can preferably be coupled to a removable lever 97 according to FIG. 13 or it could take the form of to a disk 110 according to FIG. 14. A removable lever has the advantage that this is not visible when removed. The actuating element 97 can preferably be actuated when the door 95 is closed e.g. it projects lightly over the gap between the top 96 of the door 95 and the lower edge of the worktop of the door (not shown). It is also possible to have an actuating element 97 which is only actuated using a screwdriver, for example, when the door 95 is closed and/or open.

In another fourth embodiment (not shown) the pivoted lever 75 can be operated by means of a tension cable with restoring spring from the clip handle 100 of the door 95.

In a further embodiment the movement of the pin 70 is accomplished using a preferably electric actuator. For example, this can be a wax expansion element, a bimetal part, an electromagnet or an inserted or withdrawn memory part. The child safety feature is activated and deactivated by means of a mechanical, electrical or electronic appliance control. The pin 70 can also be part of the actuator.

Various possibilities exist for the control logic: for example, the child safety feature can be continuously activated or only during operation of the household appliance. The child safety feature can also deactivated by programming, i.e. a special button or a special combination of buttons must be pressed to open the door 95. This embodiment with an actuator can be used in all appliance designs, e.g. a free-standing appliance, a build-under appliance, an integrated build-under appliance and a fully integrated build-under appliance. It is also possible for the activation and deactivation to be accomplished by remote control, preferably via a radio signal. The control system has a corresponding receiving portion for this purpose. Remote control can be secured against unauthorised actuation by means of a coding, e.g. a password. For household appliances connected to the Internet, the activation or deactivation can be accomplished by the internet.

The present invention provides a simple and inexpensive device for a child safety feature in household appliances with a door, especially a dishwasher, with an emergency unlocking function. As a result of the different embodiments, an optimal adaptation to different design variants can be made both for a mechanical actuation and for actuation using an actuator.

The invention claimed is:

1. An electric household appliance, comprising:

a receptacle for receiving items to be handled by the electric household appliance;

a door permitting access to the receptacle; and a door lock for the door, the door lock having a frame located on the door with an opening for a hook, a closing member movably mounted in the frame, a closing spring disposed between the closing member and a counter-bearing in the frame, a gripping device that can be gripped and moved by a user to open the door lock, the closing member being operatively connected to the gripping device, and means for selectively blocking movement of the closing member, the means for selectively blocking movement of the closing member being selectively positionable between a first position in which the means for selectively blocking movement of the closing member blocks a movement of the closing member, whereupon the blocked movement of the closing member operates as a child safety feature and a second position in which the means for selectively blocking movement of the closing member does not block movement of the closing member, whereupon the child safety feature is deactivated.

2. The electric household appliance according to claim 1, wherein, in the first position with the child safety feature activated, a locking head of the means for selectively blocking is inserted into a recess of the closing member and the movement of the closing member is thereby positively blocked.

3. The electric household appliance according to claim 1, wherein the means for selectively blocking movement comprises a locking head which, in the first position of the means for selectively blocking with the child safety feature activated, is inserted in a recess of a portion of the frame so that as a result of a positive connection between the locking head and the recess, any forces applied to the locking head are transferred to the recess.

4. The electric household appliance according to claim 2, wherein when the means for selectively blocking is located in the second position with the child safety feature deactivated, the locking head of the means for selectively blocking is located outside the recess of the closing member and thereby the movement of the closing member is not blocked.

5. The electric household appliance according to claim 4, wherein the locking head of the means for selectively blocking moves between the first position and the second position in a direction of movement that is substantially perpendicular to the direction of movement of the closing member, and wherein the locking head of the means for selectively blocking has a conical shape with increasing diameter beginning at the free end of the locking head so that, when very high forces act on the closing member, angled contact between a circumferential surface of the locking head and a bearing surface of the recess of the closing member generates a normal force that causes, the means for selectively blocking to move into the second position.

6. The electric household appliance according to claim 1, wherein the closing spring is tensioned, and wherein the gripping device is pressed against a part of the frame by the closing spring at a contact point when the door lock is in an open position, wherein the gripping device has a gripping latch into which the hook is guided on passing through the opening in the frame and has a contact surface onto which the incoming hook presses, thereby causing a movement of the gripping device, wherein the gripping device is shaped so that it rotates and loses contact with the contact point as the hook presses into the gripping device, and wherein the closing spring thereafter presses the gripping device into a new position which latches the door lock in a closed position.

7. The electric household appliance according to claim 1, wherein the means for selectively blocking comprises a locking head that is fixed to a pivoted shaft by means of a pivoted lever so that the locking head of the means for selectively blocking can execute a rotary movement between the first position and the second position.

8. The electric household appliance according to claim 7, wherein the means for selectively blocking further comprises a restoring lever connected to the pivoted shaft and a spring that acts against the restoring lever to apply a restoring moment to the pivoted shaft so that the means for selectively blocking is biased towards the first position to activate the child safety feature.

9. The electric household appliance according to claim 7, wherein the means for selectively blocking further comprises an adjusting lever connected to the pivoted shaft, wherein a rectangular plate is formed on the adjusting lever, the rectangular plate including a protruding locating lug and a protruding limiting lug, and wherein the plate is elastically deformable.

10. The electric household appliance according to claim 9, wherein the door lock comprises a handle with a gripping shell, and wherein a free end of the adjusting lever projects partly over a slot-shaped recess in the gripping shell, and wherein a lateral or horizontal movement of the free end of the adjusting lever will cause pivoting movement of the pivoted shaft that will cause the means for selectively blocking to be moved between the first position and the second position.

11. The electric household appliance according to claim 10, wherein the adjusting lever is used to fix the means for selectively blocking in the second position for continuous deactivation of the child safety feature.

12. The electric household appliance according to claim 1, wherein the means for selectively blocking is arranged on an actuating slider in a slider housing and by means of a translational movement of the actuating slider in the slider housing, the means for selectively blocking can be moved between the first position and the second position.

13. The electric household appliance according to claim 12, wherein the door lock comprises a handle with a gripping shell, and wherein the means for selectively blocking further comprises an actuating lever formed on the actuating slider, the actuating lever projecting from a slot in the gripping shell of the handle, wherein the actuating slider is moved with the actuating lever to move the means for selectively blocking between the first and second positions, and wherein the actuating lever is pressed into the first position by a spring.

14. The electric household appliance according to claim 13, wherein the means for selectively blocking further comprises a locating lug formed on the actuating slider, wherein when the means for selectively blocking is in the second position, the actuating slider engages in a recess of the slider housing.

15. The electric household appliance according to claim 1, wherein the movement of the means for selectively blocking between the first and second positions to activate and deactivate the child safety feature can be accomplished from a top of the door using an actuating element.

16. The electric household appliance according to claim 15, wherein the actuating element is removably mounted on the top of the door.

17. The electric household appliance according to claim 16, wherein the actuating element is connected to an actuating shaft on which a cam is formed, and wherein rotation of the actuating shaft causes the cam to move the means for selectively blocking between the first and second positions.

18. The electric household appliance according to claim 1, wherein the closing spring biases the closing member towards a locked position.

19. The electric household appliance according to claim 1, wherein the gripping device is pivotally mounted on the closing member.

* * * * *

UNITED STATES PATENT AND TRADEMARK OFFICE

CERTIFICATE OF CORRECTION

PATENT NO. : 8,651,535 B2
APPLICATION NO. : 10/579280
DATED : February 18, 2014
INVENTOR(S) : Oppel et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1657 days.

Signed and Sealed this
Twenty-ninth Day of September, 2015

Michelle K. Lee

Michelle K. Lee
*Director of the United States Patent and Trademark Office*